United States Patent [19]

Wright et al.

[11] 4,018,622

[45] Apr. 19, 1977

[54] FLUXING AGENT FOR REMOVING INORGANIC DEPOSITS FROM SMELTERS AND FURNACES

[75] Inventors: Roy E. Wright, Oakland; Howard C. Ross, City of Commerce, both of Calif.

[73] Assignee: Philadelphia Quartz Company, Valley Forge, Pa.

[22] Filed: Oct. 19, 1973

[21] Appl. No.: 408,027

[52] U.S. Cl. ..... 134/19; 252/86; 252/87; 252/135; 252/140

[51] Int. Cl.[2] ..... C11D 7/12; C11D 7/14; C11D 7/20; C23G 1/28

[58] Field of Search ..... 252/86, 87, 135, 140; 134/19, 4

[56] References Cited

UNITED STATES PATENTS

| | | | |
|---|---|---|---|
| 2,762,729 | 9/1956 | Snow | 134/19 |
| 3,240,581 | 3/1966 | O'Connell | 134/19 |
| 3,544,366 | 12/1970 | Uhlmann | 134/2 |

FOREIGN PATENTS OR APPLICATIONS

| | | | |
|---|---|---|---|
| 1,521,813 | 12/1972 | Germany | 252/135 |
| 1,621,661 | 6/1971 | Germany | 252/135 |
| 2,234,172 | 4/1973 | Germany | 252/523 |

*Primary Examiner*—Dennis L. Albrecht
*Attorney, Agent, or Firm*—Ernest G. Posner; Fred C. Philpitt

[57] ABSTRACT

A fluxing process for removing inorganic deposits from equipment used to produce base metals from ores by inclusion of alkali metal silicates, preferably as liquids or hydrates, as at least 10% of the fluxing agent, thereby improving effectiveness of the fluxing process.

10 Claims, No Drawings

FLUXING AGENT FOR REMOVING INORGANIC DEPOSITS FROM SMELTERS AND FURNACES

BACKGROUND

In the operation of smelters and furnaces for recovery, refining and upgrading of ores, minerals, and metals large amounts of impurities including inorganic dusts, dirt, ash, and slag are carried by the flames and exhaust gases to the outlet of the furnaces. Some of these particulate impurities tend to settle on the throat or uptakes while other particles tend to settle and collect throughout the outlet system. The problems are common to most smelting and refining operations, however the following discussion will be directed to copper processing.

In operation of copper reverberatory furnaces, the ore or concentrate charged to the furnace contains about 30%Cu, with the remainder being iron, silica, and other non-copper materials. The charge is of small particle size because it is usually a concentrate from a flotation system. Reverb furnaces depend on oil or gas to provide heat to melt the charge into a matte (copper) and slag. Matte is a lower liquid, slag a floating molten material going to waste. Under some conditions there may be an intermediate layer of magnetite separating matte and slag, or there may be a buildup of magnetite on the bottom of the furnace. The charge is dumped onto the slag layer, either from the hot firing end of the furnace, or from the two sides of the furnace.

In both feed systems dusting during charging and the gas velocity of the flame will result in mineral dusts being carried along by gases through the reverb, out of the reverb through an exhaust outlet called an uptake, and then into a waste heat boiler. Some of the mineral particles will settle out in the uptake where the particles sinter or fuse and accumulate into a mass large enough to cause operational difficulty — sometimes reverb shutdown.

Removal of this build-up caused by sintering and fusion is necessary, expensive, and difficult. Past techniques include melting by additional heat, use of a shot gun slug to pound off build-up, jack hammering away chunks of build-up, adding a flux (soda ash — ferrosilicon) by shovel, air gun, or hand throwing, or an oxygen lance.

Build-up removal has two distinct problems:

1. thinning out refractory walls to a dangerous degree because of poor control during removal of undesired deposits, and
2. incomplete removal can lead to uptake build-up to the point where restricted flow is critical.

A removal technique should be precise enough to remove buildup but not attack the thin sections of the uptake, and also should not aggravate solids carry-over into the waste heat boiler. The flux shoud not be so aggressive as to erode or attack refractory sections below the build-up, or any other section of the equipment encountered as the fluxed molten build-up drains into the slag area.

It must be emphasized that while most process equipment has build-up problems, these problems vary extremely in terms of severity, ease of handling, composition, location of build-up, rate of formation of build-up, and the physical geometry or design in terms of ease of getting at or removing a build-up. The build-up is related to the amount of ore fed in, its mesh size and composition, whether it has been roasted or pretreated in a fluid bed reactor, the fuel used in the reverb (gas is easier on a reverb than oil), the degree of overloading the reverb for increased production, use of auxiliary oxygen for heating, end charging versus side charging, operating temperature of the furnace, the type of refractory used (basic vs. silica), whether the reverb is operated under oxidizing or reducing conditions, and the general air tightness of the reverb.

Removal of build-up and the technique used has always been a function of quality of labor available and its cost, operating philosophy, equipment and materials available, geometry or design of the furnace and the uptake, type of refractory, composition of build-up, temperature in the uptake, and the rate of formation of build-up. Each reverb and its build-up has had to be treated and solved as a unique situation. There was no simple, pat combination of materials, equipment, or operating technique universally applicable to all conditions.

Any deposition of solids, particularly the inorganic impurities of the metal processing, out of the melting area of the smelter or furnace is objectionable for various reasons. The materials tend to restrict flow of exhaust gases by reducing the cross-sectional area of the exhaust vent. The material can cause poor heat transfer to the refractory surface. Build-up of the material can cause damage to the refractory itself. The excessive build-up can actually be the cause for shutdown of the furnace in order to remove the build-up. Extensive labor and/or hazardous conditions may be required for removal of the build-up. Build-up can damage boiler tubes and it can reduce overall thermal and melting efficiency of the equipment.

The build-up material found in these processes generally contains high ratios of inorganic dust, and it has been the prior art practice to introduce alkali-containing fluxing agents which tend to form a glass with the build-up material that will run back into the melt of the equipment as slag. Some of the more common and recognized fluxing materials are soda ash, ferrosilicon, calcium carbide, lime, iron pyrites and silica. Soda ash is probably the most common as it is a very low cost fluxing agent. It has poor particle size, shape and density; it blows away very easily, and it does not have any tendency to stick to the surface of the build-up. Its effectiveness is based upon the ability of a small percent of the soda ash applied to react with the build-up while in contact with it. While it is very cheap, most of the soda ash is not utilized but is carried away with the exhaust gases, presenting new problems in an air pollution conscious environment. The soda ash also tends to react with or attack the refractories.

Ferrosilicon is a highly effective, high density powder which is rather costly as a fluxing agent. It will react with magnetite in the build-up to reduce iron in producing low melting slag. In some instances it can be too reactive and go through refractory brick easily.

Calcium carbide has a fluxing mechanism and is not completely understood; however it is believed that the carbide is a reducing agent which probably reacts with the metal components in the build-up. Calcium carbide does create a run-off of the build-up material which is rather thin and tends to boil violently.

Lime is generally used in combination with some of the other fluxing agents, such as soda ash.

The iron pyrites have generally been suggested as suitable substitutes for ferrosilicon, being at a lower price, with some loss in effectiveness.

THE PRESENT INVENTION

We have now found that superior fluxes can be prepared utilizing either partially or totally hydrated alkali metal silicates or liquid alkali metal silicates or lower ratio alkali metal silicate glasses alone or in conjunction with prior art fluxing agents. The hydrated alkali metal silicates have a tendency when heated to adhere to surfaces such as the walls, roofs or structure members of the furnace until a flowable glass is formed. The glass will then run off and return to the slag of the main furnace. The more common fluxes, such as soda ash, have little or no adhesive characteristics until they react with the build-up, therefore the major portion of these fluxing agents is lost in the exit gases — requiring expenditures in pollution-control devices to remove such particles from the gases before they are introduced to the atmosphere. Even a hydrated ash is not very adhesive and will have a tendency in the environment of a metal furnace to dry out before it gets to the surface of the build-up. The recognized fluxes of the prior art are generally finer and lower in density than those of the present teachings, therefore they will not carry completely across the relatively high velocity gas stream in the exhaust system of the furnace but rather will tend to be carried to the exit of the furnace.

Suitable materials for the present improved fluxing agents are:

a. Hydrated crystalline sodium metasilicate particles having a size ranging from about 20 to 65 mesh on the Tyler screen, with a bulk density in excess of 60 lbs./cu.ft. These crystals melt at 48° to 88° C in their own water of crystallization to viscous adhesive particles, b. Hydrous powdered silicates also will dissolve in their water of hydration at temperatures of about 60° to 90° C to give viscous adhesive particles. These powders normally contain 10 to 30% water by weight and would have an $SiO_2/M_2O$ mole ratio of 1.1 to 3.9/1.0, c. Anhydrous soluble alkali glasses will soften at temperatures of 1000° to 1300° C to form sticky masses. When these glasses are premoistened or dampened they will become sticky at 60° to 90° C and adhere to the surfaces of the equipment interior when they come in contact therewith. Sodium silicate glasses having an $SiO_2$ to $M_2O$ mole ratio of less than 2.2 to 1.0 and potassium silicate glasses having an $SiO_2$ to $M_2O$ mole ratio of less than 3.92 to 1 are suitable for use in this process, and d. Crystalline hydrates of sodium sesquisilicates could likewise be utilized in this process as the sesquisilicate will form an adherent mass in its own water of hydration.

As noted above, the fluxing process is essentially a reaction between the alkali in the fluxing agent with the inorganic particles deposited as build-up on the equipment to form a glass which tends to run back into the lower portion of the equipment and become part of the slag which can be removed through normal furnace processes and procedures.

In view of the reaction desired, it is preferable that the fluxing agents have high amounts of alkali therein. Typical $Na_2O$ contents are:

| | |
|---|---|
| Soda ash | 58.5% |
| Anhydrous Metasilicate | 50.5% |

-continued

| | |
|---|---|
| Metasilicate Pentahydrate | 29.5% |
| 2.07 ratio hydrous sodium silicate | 27% |
| 2.48 ratio hydrous sodium silicate | 24% |
| 3.33 ratio hydrous sodium silicate | 19.5% |
| NaOH | 77.5% |
| Hydrated sodium sesquisilicate | 36.7% |

The silicate ratio has an effect on the flow point of the various hydrated particles and a particle having a ratio of 3.87 has a flow point of about 1600° F, while 1.65 ratio material has a flow point of 1345° F. Accordingly, it is advantageous to start with high alkalinity and low ratio to flux the most inorganic build-up. When the flux material contains more than about 75% $SiO_2$, the melting point increases up to 1700° C. It is advantageous to use enough alkali to maintain minimum melting point of the fluxed material, or about 60 to 75% $SiO_2$.

A better understanding of the melting point of the various sodium silicate materials can be had by referring to Volume I of "Soluble Silicates" by James G. Vail, with particular reference to page 112, figures 4.3 and 4.4. This material is incorporated herein by reference.

Another variable which can work to advantage, depending upon the system and the type of furnace being utilized, is the use of sodium-potassium double silicates as the fluxing agent. The double silicate has a lower melting and flow point than the sodium silicate alone.

The procedures presently used for introducing fluxing agents into smelters and furnaces can all be utilized in practicing the present invention. Fluxing agents have been packaged in small bags and hand thrown through openings in the furnace so the bag will hit a desired spot, break, and allow the powder to fall around the dust and melt it away.

The flux can be introduced into the furnace utilizing a dry gun, such as an Allentown Pneumatic Gun, and blowing it from the gun hose into the furnace at the desired location. Similar applications have been made utilizing guns equipped with a water nozzle to ensure that the fluxing powder is moistened as it goes into the furnace.

Fluxing agents have literally been shoveled by hand and thrown in the general direction of the areas where the build-up is occurring.

The liquid silicates of this invention tend to lose some of their moisture thereby becoming adherent and sticky by the time they contact the various surfaces of the build-up. The mechanism of melting or moisture loss occurs during exposure of the improved flux to the hot gases during its travel from entrance into the smelter until it hits the build-up surface and/or contact with the hot surface.

EXAMPLE 1

Soda ash was packaged in 2 lb. quantities in polyethylene bags and thrown onto walls and surfaces of an operating copper reverberatory furnace. The bags ruptured on contact with target areas however the fine powder tended to be carried away through the stack due to the high velocity of the exhaust gases. After 30 minutes there was no notable reduction in the build-up within the area where the bags had contacted the walls of the furnace.

EXAMPLE 2

Sodium metasilicate pentahydrate was packaged in 2 lb. quantities in polyethylene bags and a like number of bags as in Example 1 were thrown onto walls and surfaces of the operating copper reverberatory furnace. Bags ruptured on contact as did those filled with soda ash, however the metasilicate held to and spread over the hot surface due to its adherent characteristic. A major amount of the metasilicate adhered to the target surface and within30 minutes melted glass could be observed leaving the target area.

EXAMPLE 3

Sodium metasilicate pentahydrate was placed in an Allentown Pneumatic Gun and blown by air pressure onto built up hot surfaces within a copper smelter. The metasilicate melted and adhered on contact with the uptake walls. Within 30 minutes fluxing on the build-up was noted and undesirable solids were flowing away from the target area.

EXAMPLE 4

Similar tests were utilized with sodium carbonate, however it was easily detected that major amounts of the sodium carbonate bounced back from the target area and were carried away by exhaust gases without any notable effect on solids build-up on the walls.

In order to get the best balance of viscosity, flux effect and efficiency in build-up removal, it may be desirable to blend the silicate flux with soda ash or ferrosilicon or other fluxing materials. This would be done to obtain some special effect of the prior art flux agents such as low cost, high density, or chemical properties, along with the low melting, adhesive and viscosity benefits of silicates.

EXAMPLE 5

A blended fluxing agent containing 90% soda ash and 10% crystalline hydrates of sodium sesquisilicate can be packaged in 2 lb. bags and hand thrown at the target area within the copper reverberatory furnace. Visual examination shows that less of the material is carried away than that of Example 1 and within 30 minutes one can note the resultant improved fluxing which occurs accompanied by the flowing away of the built up material.

EXAMPLE 6

A blended fluxing agent is prepared consisting of one-third hydrated amorphous sodium silicate having 18% water by weight and having an $SiO_2$ to $M_2O$ mole ratio of 2.2 to 1 and two-thirds soda ash on a weight basis. The blended material can be applied to the walls of a reverberatory furnace utilizing a pneumatic air gun. The hydrated amorphous sodium silicate passing through hot gases becomes tacky and by the time it strikes the surface of the build-up it, along with the majority of the soda ash, tends to adhere to the wall and flux the build-up material causing the build-up to melt away.

EXAMPLE 7

A potassium silicate solution having a weight ratio of $SiO_2$ to $K_2O$ of 2.5 can be applied to a target area within an operating furnace utilizing a wet gun. The material tends to lose moisture from the time it enters the furnace until it strikes the target area and the material is an adherent, sticky mass as it strikes the target area — thereby attacking the build-up and causing a reaction with the inorganic material therein. A glass-like melt is formed and it tends to run into the slag area of the furnace.

EXAMPLE 8

A blended mixture was prepared containing 50% by weight soda ash and 50% by weight crystalline hydrated sodium metasilicate. The dry mix was packaged in 2 lb. polyethylene bags and hand thrown at a designated target area within an operating reverberatory copper furnace. Upon hitting the surface the bags burst and the material therein tended to adhere to the build-up in the target area. Visual observation indicated that very little of the material was carried away and this was confirmed by an examination of the exhaust gases. Within 30 minutes the reaction between the fluxing agents and the build-up was easily detected and one could see the resultant material melting and returning to the slag area in the furnace.

EXAMPLE 9

Readily soluble sodium silicate glass having a mesh size of less than 20 and having an $SiO_2$ to $Na_2O$ mole ratio of 1.8 to 1 can be introduced into a reverberatory furnace with an air gun and directed to the designated target area where a build-up is present. The heat within the furnace will cause the material to tend to soften or melt prior to contacting the target area and it will adhere to the target area and react with the inorganic solids therein yielding a glass-like material which melts and runs from the build-up area.

EXAMPLE 10

Readily soluble potassium silicate glass particles having a mesh size of 20 to 45 and an $SiO_2$ to $K_2O$ mole ratio of about 3.2 to 1 can be introduced into an operating reverberatory furnace utilizing an air gun. The material tends to melt from the heat of the furnace and becomes adherent and sticks to the designated target area upon contact. The material reacts with the inorganic solids of the build-up causing the formation of a glass which melts and flows from the target area.

EXAMPLE 11

A blended fluxing composition consisting essentially of 50% hydrous 2.2 ratio sodium silicate having 18% water therein, 40% soda ash and 10% ferrosilicon can be introduced into an operating reverberatory furnace as in Example 2. The composition has the desired fluxing properties and after a short period of time inorganic dust can be observed leaving the target area.

The above examples are not meant to be restrictive but are indicative of the broad scope of improved fluxing agents which can be obtained utilizing alkali metal silicates in smelters and other furnaces to chemically react with the build-up therein and remove said build-up through the formation of glasses which melt and leave the build-up area. Typical expansion of the inventive concept disclosed herein would include the use of sodium metasilicate hexahydrate and pentahydrate.

The examples and the discussion have been limited to copper reverberatory furnaces, however the principles and process of the present application are also applicable to nickel smelters, zinc and lead smelters, coke ovens, fiberglas and glass furnace operations, sludge burning incinerators, as well as refinery operations and steel mills where problems occur with build-up of inorganic impurities which are formed in the process.

What we claim is:

1. In the process for the removal of inorganic dusts, ash, dirt, slag and other impurities deposited on the walls and uptakes of copper smelters, by contacting said impurities with fluxing agents at the operating temperatures of said smelters and equipment, the improvement comprising the use of a fluxing agent consisting essentially of 10 to 100% alkali metal silicate selected from the group consisting of a. crystalline hydrates of sodium metasilicate;
b. crystalline hydrates of sodium sesquisilicate;
c. hydrated amorphous sodium, potassium or mixed sodium-potassium silicate powders containing 10–30% water by weight and having a mole ratio of 1.1 to 3.9 parts of $SiO_2$ per part of $M_2O$, and
d. liquid sodium, potassium or mixed sodium-potassium silicates having a mole ratio of 0.75 to 3.9 parts of $SiO_2$ per part of $M_2O$ and 0 to 90% of a chemical selected from the group consisting of soda ash, ferrosilicon, silica, calcium carbide, lime and iron pyrites.

2. The process of claim 1 wherein at least 10% of the fluxing agent is a crystalline hydrate of sodium metasilicate.

3. The process of claim 1 wherein at least 10% of the fluxing agent is sodium metasilicate pentahydrate.

4. The process of claim 1 wherein the fluxing agent consists essentially of one-third to two-thirds soda ash and two-thirds to one-third crystalline hydrate of sodium metasilicate.

5. The process of claim 1 wherein the alkali metal silicate is hydrated amorphous sodium, potassium or mixed sodium-potassium silicate powders containing 10–30% water by weight and having a mole ratio of 1.1 to 3.9 parts of $SiO_2$ per part of $M_2O$.

6. The process of claim 1 wherein the alkali metal silicate is liquid sodium, potassium or mixed sodium-potassium silicates having a mole ratio of 0.75 to 3.9 parts of $SiO_2$ per part of $M_2O$ and a moisture content of 40 to 70% by weight.

7. The process of claim 1 wherein the fluxing agent is a combination of anhydrous sodium metasilicate and sodium metasilicate pentahydrate.

8. The process of claim 1 wherein the fluxing agent consists essentially of 10 to 90% alkali metal silicate and 10 to 90% of one or more chemicals selected from the group consisting of soda ash and ferrosilicon.

9. In the process for the removal of inorganic dusts, ash, dirt, slag and other impurities deposited on the walls and uptakes of reverberating smelters used to recover copper from ores, by contacting said impurities with fluxing agents at the operating temperatures of said smelters and equipment, the improvement comprising the use of a fluxing agent consisting essentially of 10 to 100% alkali metal silicate selected from the group consisting of a. crystalline hydrates of sodium metasilicate;
b. crystalline hydrates of sodium sesquisilicate;
c. hydrated amorphous sodium, potassium or mixed sodium-potassium powders containing 10–30% water of weight, having a mole ratio of 1.1 to 3.9 parts of $SiO_2$ per part of $M_2O$, and
d. liquid sodium, potassium or mixed sodium-potassium silicates having a mole ratio of 0.75 to 3.9 parts of $SiO_2$ per part of $M_2O$ and a moisture content of 40 to 70% by weight; and 0 to 90% of a chemical selected from the group consisting of soda ash, ferrosilicon, silica, calcium carbide, lime and iron pyrites.

10. The process of claim 9 wherein at least 10 % of the fluxing agent is a crystalline hydrate of sodium metasilicate.

* * * * *